US011136735B2

(12) United States Patent
Parrott et al.

(10) Patent No.: US 11,136,735 B2
(45) Date of Patent: Oct. 5, 2021

(54) IMPACT-RESISTANT AND ENERGY-ABSORBING BOLLARD SYSTEM

(71) Applicant: SlowStop Guarding Systems, LLC, San Antonio, TX (US)

(72) Inventors: Kenneth Parrott, Helotes, TX (US); Gregory L. Hannah, San Antonio, TX (US)

(73) Assignee: Slow Stop Guarding Systems, LLC, San Antonio, TX (US)

( * ) Notice: Subject to any disclaimer, the term of this patent is extended or adjusted under 35 U.S.C. 154(b) by 0 days.

(21) Appl. No.: 16/705,631

(22) Filed: Dec. 6, 2019

(65) Prior Publication Data

US 2020/0270830 A1 Aug. 27, 2020

Related U.S. Application Data

(60) Provisional application No. 62/808,372, filed on Feb. 21, 2019.

(51) Int. Cl.
*E01F 9/627* (2016.01)

(52) U.S. Cl.
CPC ..... *E01F 9/629* (2016.02)

(58) Field of Classification Search
CPC . E01F 9/602; E01F 9/627; E01F 9/629; E01F 9/681
USPC ..... 40/608; 404/10
See application file for complete search history.

(56) References Cited

U.S. PATENT DOCUMENTS 3,902,818 A * 9/1975 Boone ..... E01F 9/61 404/10
3,913,518 A * 10/1975 Kaplan ..... E01F 9/629 116/63 C
5,379,716 A * 1/1995 Helland ..... E01F 9/627 116/63 R
6,099,412 A * 8/2000 Weibye ..... E01F 15/0469 473/150
6,719,484 B1 * 4/2004 Johnson ..... E01F 9/675 116/63 P
8,348,545 B1 * 1/2013 Hughes, Jr. ..... E01F 9/629 404/10
9,713,760 B2 * 7/2017 Peacock ..... A63K 3/043
9,988,777 B2 * 6/2018 Lee ..... E01F 9/608
2009/0279951 A1 * 11/2009 Wheeler, Jr. ..... E05D 7/0423 404/10
2010/0254761 A1 * 10/2010 Wheeler, Jr. ..... E01F 9/619 404/10
2011/0131852 A1 * 6/2011 Nelson ..... E01F 9/681 40/607.12

OTHER PUBLICATIONS

Abstract and drawing from CN 2018136775 U, published Nov. 2018.*

* cited by examiner

*Primary Examiner* — Gary S Hartmann

(57) ABSTRACT

A bollard system having a main post; a post collar; a base plate; and an energy-absorbing element. The base plate has an arcuate outer wall and inwardly projecting mounting fastener notches around the bottom of the base plate. The post, the post collar and the base plate are shaped such that when the post is loaded above the base plate, an obliquely, downwardly directed sliding movement of the post and post collar relative to the base plate is obtained and is damped by the energy-absorbing element.

3 Claims, 8 Drawing Sheets

IMPACT-RESISTANT AND ENERGY-ABSORBING BOLLARD SYSTEM

BACKGROUND OF THE INVENTION

The present invention relates to bollards such as are used to alert traffic of an obstacle to be avoided and, more particularly, to an improved impact-resistant and energy-absorbing bollard system over that of U.S. Pat. No. 9,938,677B2 (the '677 Patent), the disclosure of which is incorporated herein by reference for all purposes.

The bollard of the '677 patent comprised only a post, a base plate, and an energy-absorbing element, wherein the post and base plate were shaped in such a manner that when the post was loaded by an external force just above the base plate, an obliquely, downwardly directing sliding movement of the post relative to the base plate was obtained, which was dampened by the energy-absorbing element, not only in the lengthwise direction of the bollard, but also in the direction perpendicular to that lengthwise direction.

The present improvement invention relates to the base plate of such a bollard. The improved base plate utilizes an outer arcuate wall structure which eliminates hard edges and allows for dispersion of energy into a uniform arcuate wall. The base plate further has inwardly projecting foundation mounting fastener notches to provide a more efficient and improved operation of the bollard upon impact, including avoiding a trip-hazard with outward extending mounting feet.

In the improved bollard a post collar member is affixed to the bottom portion of the main impact post by set screw fasteners and provides reinforced strength to the system as the impact post moves from a normal position to deflected position.

BRIEF DESCRIPTION OF THE DRAWINGS

The foregoing aspects and many of the attendant advantages of this improvement invention will become more readily appreciated as the same becomes better understood by reference to the following detailed description, when taken in conjunction with the accompanying drawings, where.

DETAILED DESCRIPTION OF A PREFERRED EMBODIMENT

Figure 1:
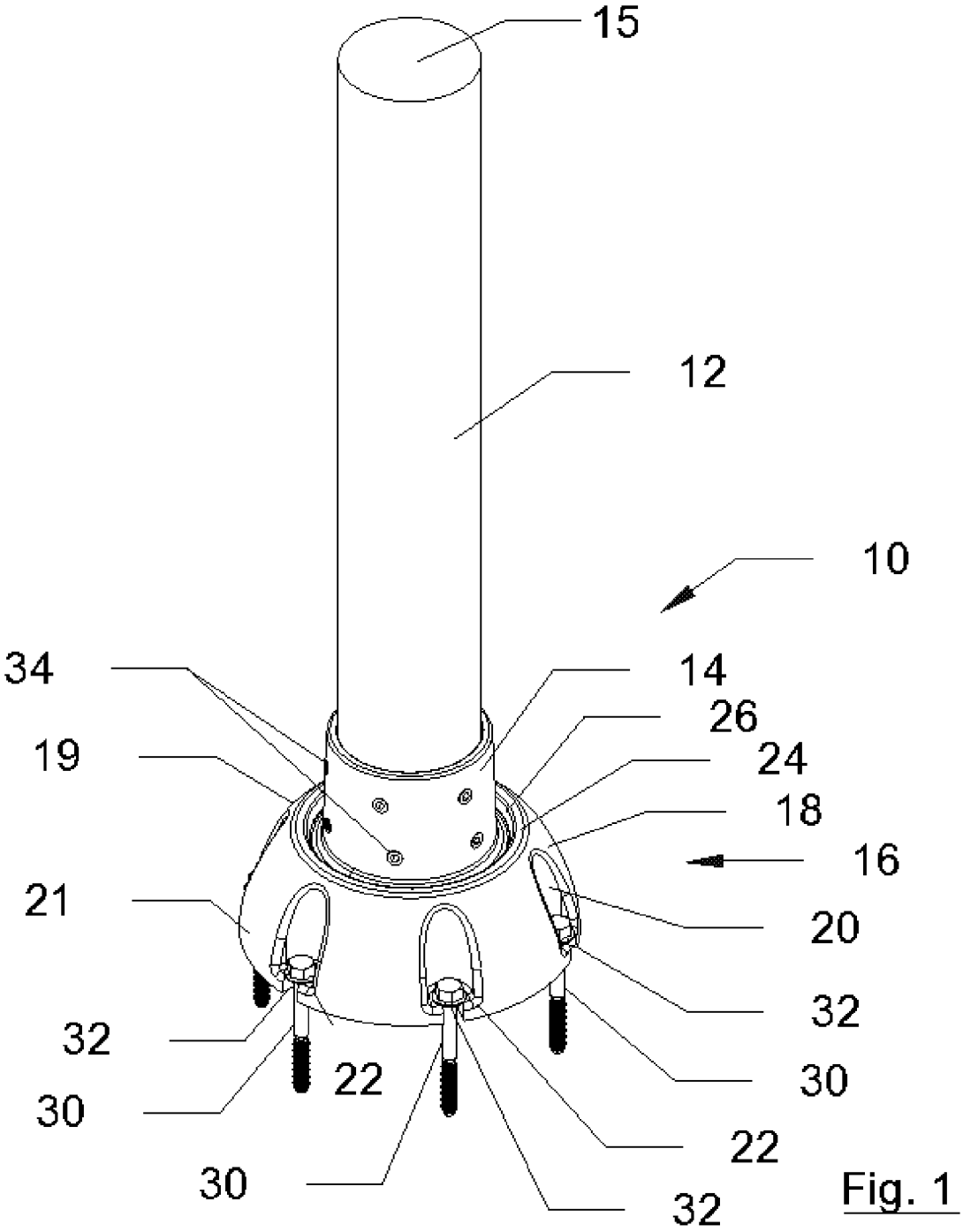
FIG. 1 illustrates a front, perspective view of the improved bollard formed in accordance with the disclosure prior to impact to the main post.

The present disclosure will be described with respect to particular embodiments and with references to certain drawings, but the disclosure is not limited thereto. Since the present invention is an improvement to the bollard disclosed in U.S. Pat. No. 9,938,677B2 that disclosure is incorporated herein for all purposes and may be referred to for additional understanding of the present invention.

The drawings are only schematic and are non-limiting. In the drawings, size of some of the elements may be exaggerated for illustrative purposes and not drawn on scale. Specific and relative dimensions do not necessarily correspond to actual reductions to practice of the disclosure. The various embodiments are solely examples and are not limiting the scope of the invention.

FIG. 1 illustrates a front perspective of the improved bollard 10 showing the main impact post 12 with the post cap 15, the reinforcing post collar 14, set screw fasteners 34, the base plate 16 with the arcuate outer wall 18 and the inwardly projecting mounting fastener notches 20 around the bottom 22 of the base plate 16. Also illustrated are an upper collar 24 of the base plate 16 and the upper opening 26 of the base plate 16.

It will be understood that the base plate 16 is intended to be fastened to a base or ground, wall or supporting structure G (FIG. 2) by means of mounting fasteners 30 disposed in the notches 20 and extending through mounting holes or slots 32 in the bottom 22 of the base plate 16.

The base plate 16 consists of an arcuated outer wall 18 which encloses a hollow space 17 (FIG. 5A) and which is provided at an upper end 19 with an inwardly directed upper collar 24 which partially seals the hollow space 17 in the direction of the post collar member 14, thereby creating an upper opening 26 which provides access to this hollow space 17 and which at its other, lower end 21 (See FIG. 1), is provided with inwardly directed or projecting mounting fastener notches 20 which are provided with bores or slots 32 for fastening the base plate 16 to the ground surface, foundation, wall support, or supporting structure G (FIG. 2) by means of screws or bolts 30.

In this improvement the wall 18, including the inner wall portion 18*a*, of the base plate 16 wall is arcuate, rather than cylindrical or rectangular, thereby providing increased strength to the base 16 with the hollow space 17 arranged centrally to bollard 10. The outer wall 18 and inner wall 18*a* terminate in the opening 26 of the hollow space 17 at upper collar 24. The opening 26 is so small that practically all points of the post collar 14 may be an active point of application for the external forces which act on the main bollard post 12, and not the base plate 16.

Figure 2:
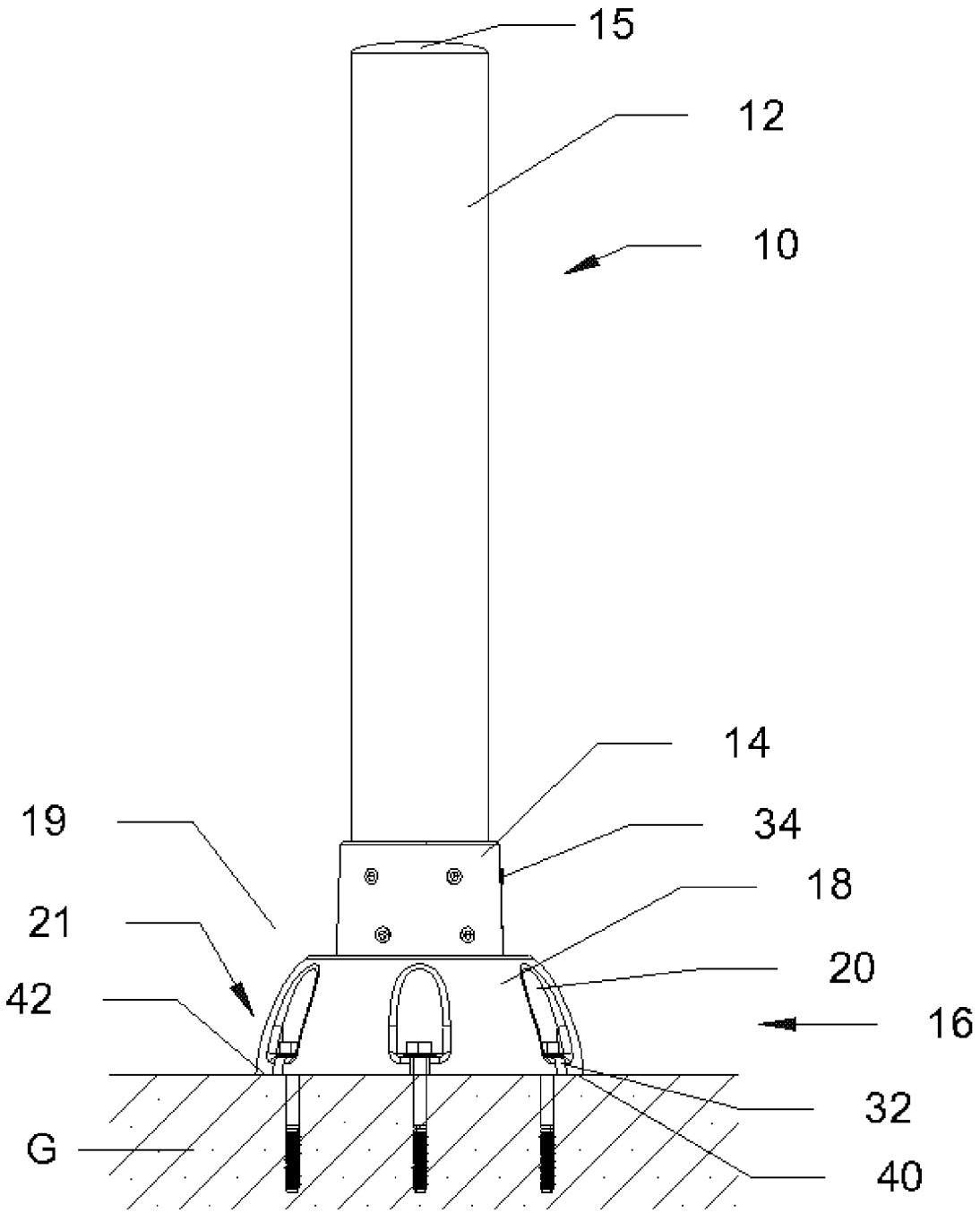
FIG. 2 illustrates a front elevation view of the present invention.
Figure 3:
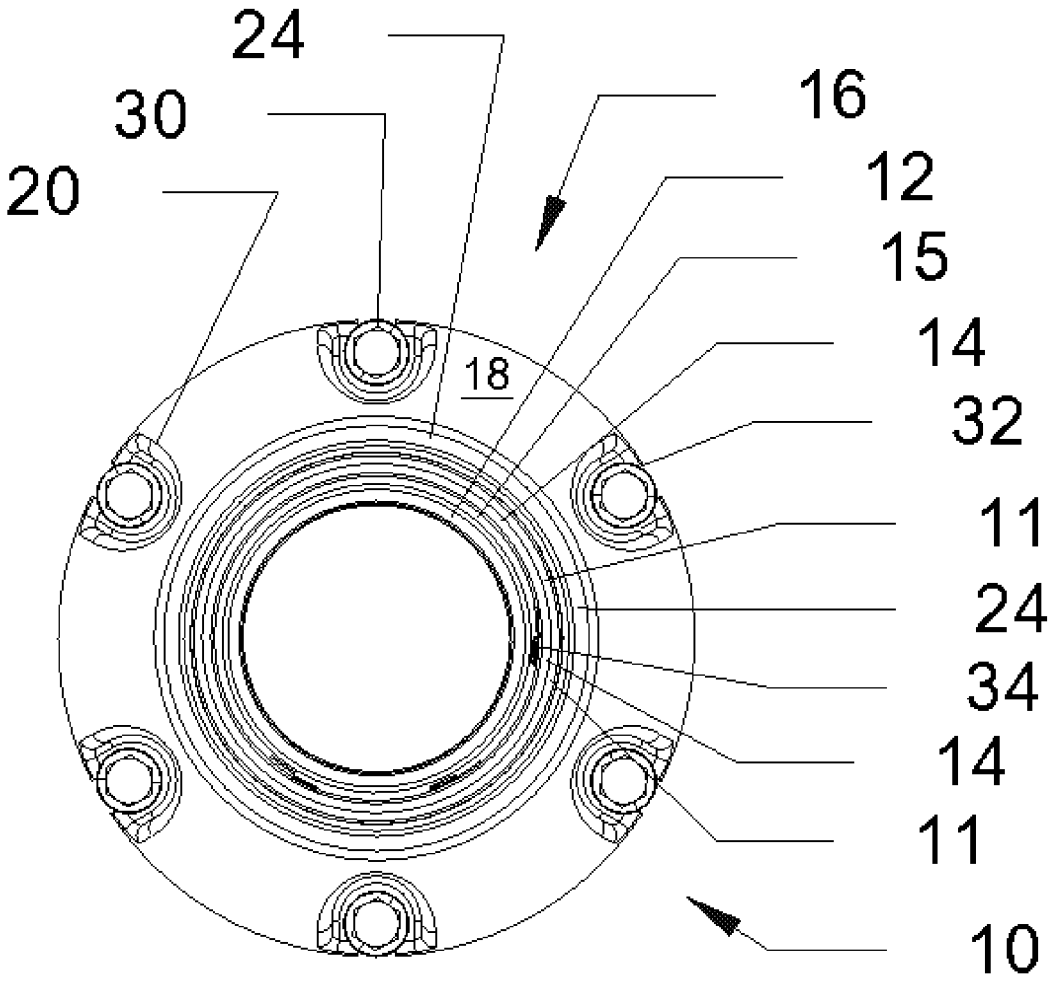
FIG. 3 illustrates a top plan view of the present invention.
Figure 4:
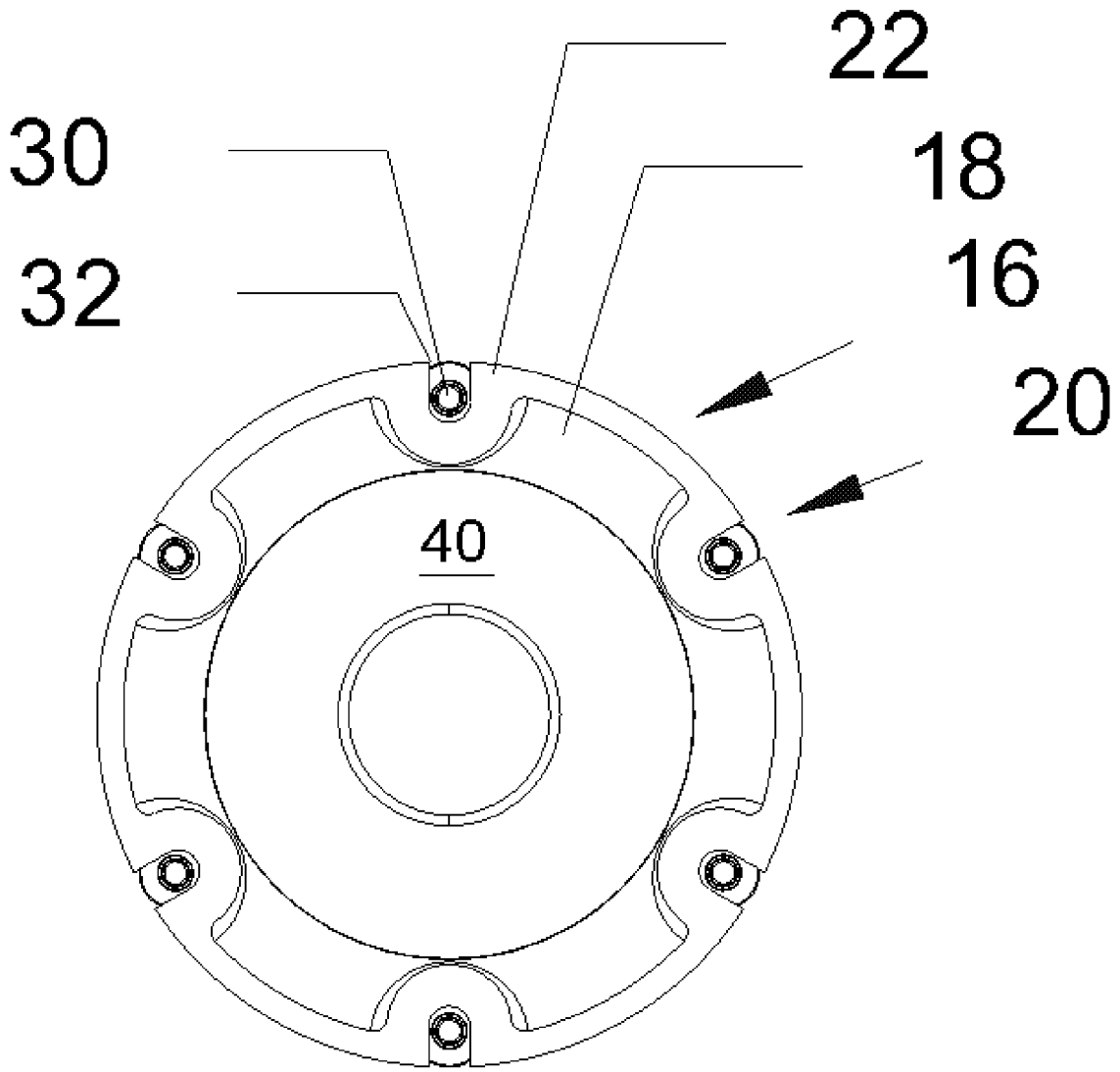
FIG. 4 illustrates a bottom plan view of the present invention.
Figure 5A:
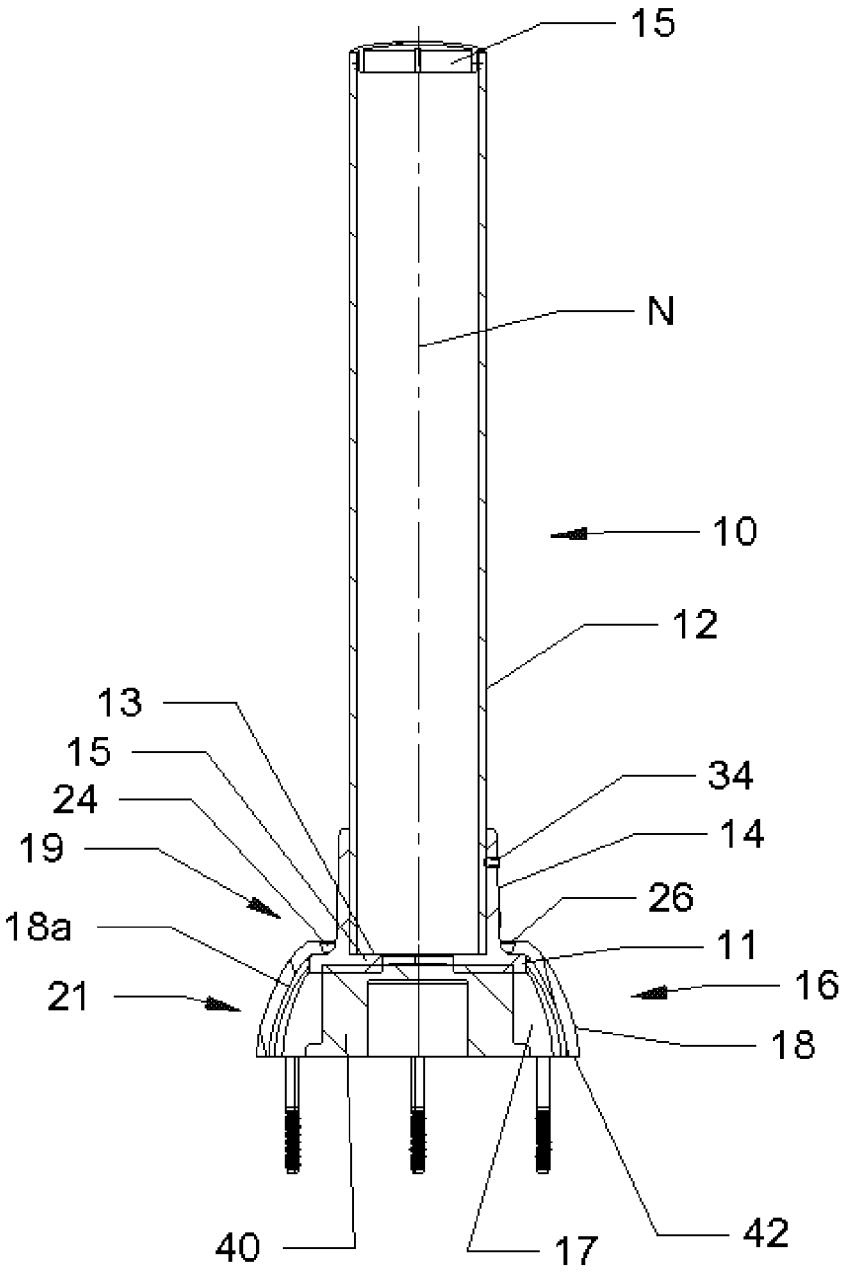
FIG. 5A illustrates a cross section view of the invention shown in FIG. 2.

The post 12 and reinforcing post collar 14, in FIGS. 1 and 2, are cylindrical (See also FIGS. 3 and 4). As seen in FIG. 5A, the post 12 is removably secured inside the post collar 14 by set screw fasteners 34 with the bottom 13 of the main post 12 against an inwardly directed flange 15 of the collar 14. The collar 14, on the side or edge facing the arcuated inner wall surface 21 of the base plate 18, has an outwardly directed or extending flange 11 which is also arranged radially. When assembled the flange 11 is located in the hollow space 17 so that post collar 14 projects through the opening 26 and this flange 11 extends beneath the inwardly directed upper collar 24 of the base plate 16 because the outside diameter of the flange 11 is greater than the inside dimension of the upper collar 24 which is also the diameter of the opening 26.

Figure 5B:
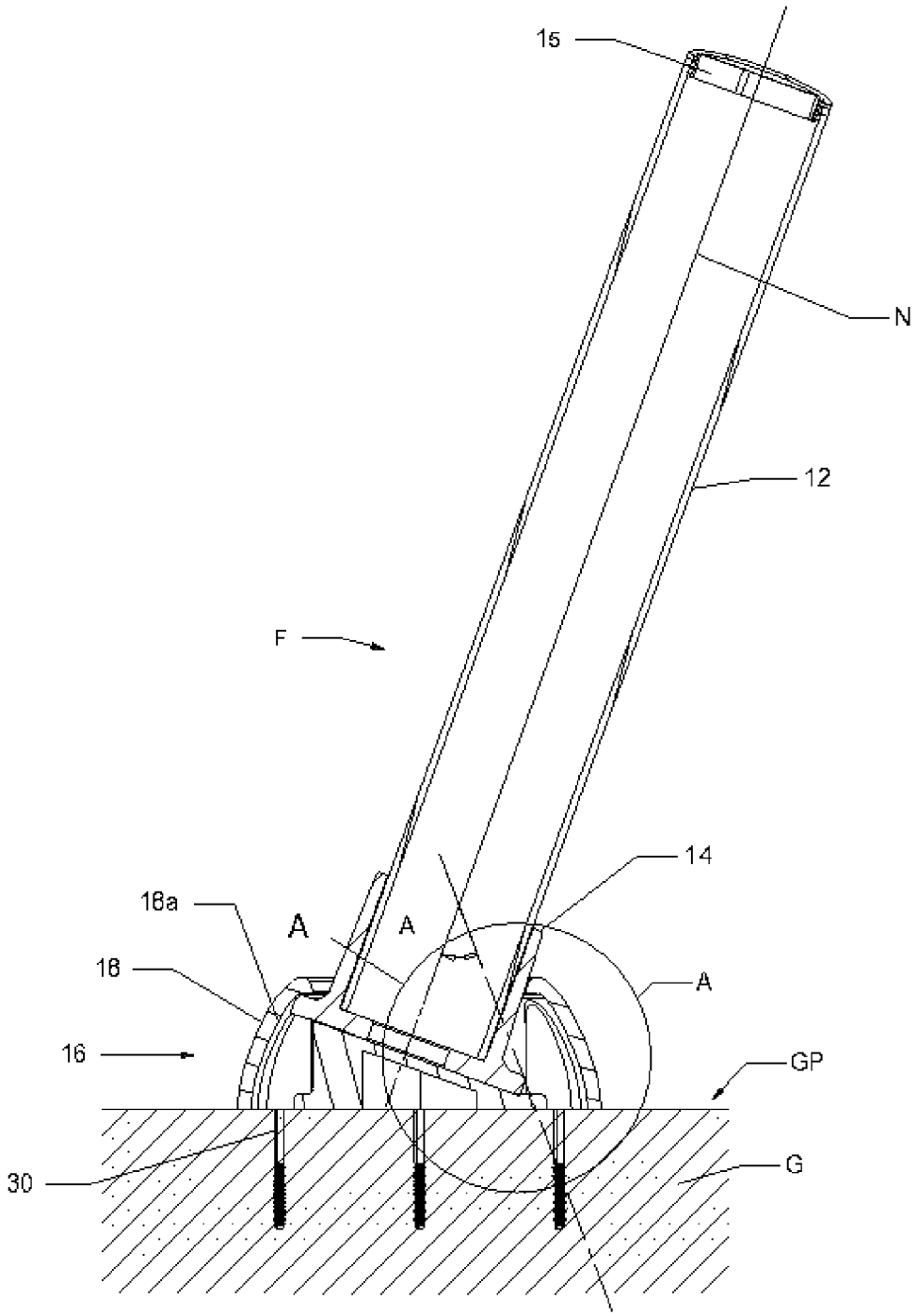
FIG. 5B illustrates a cross section view of the invention shown in FIG. 2 with the main post and post collar deflected from a normal position upon an impact force to the main post member.
Figure 5C:
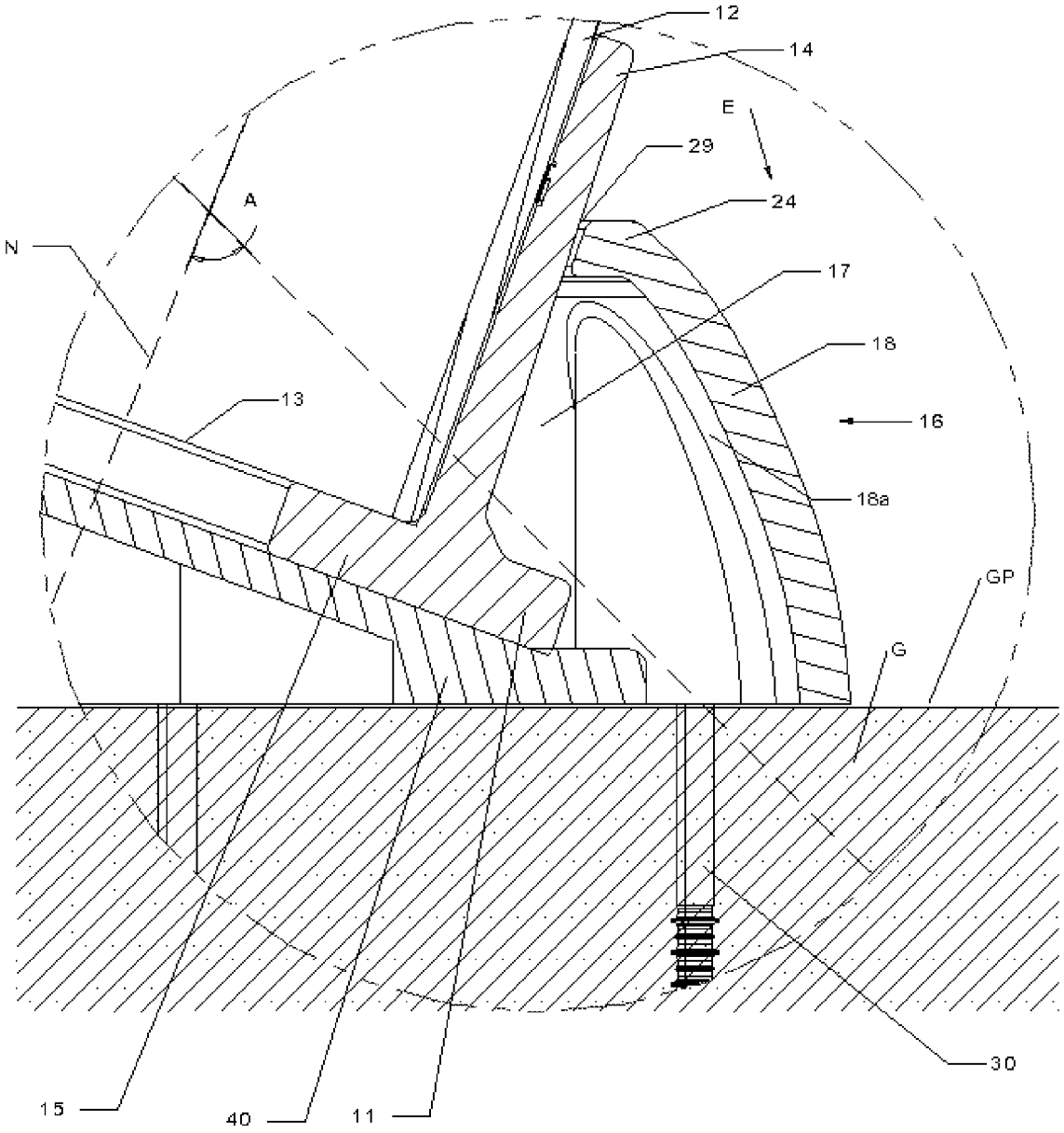
FIG. 5C illustrates a detailed view of the intersection of the main post, the post collar, and the base plate as the post is deflected from a normal position.

The dimensions of these interacting flanges 11 and collars 24 sliding into one another and creating a first direct contact between the reinforcing post collar 14 and the base plate 16 are not only such that there is sufficient lateral clearance between the two parts on the one hand and respectively the wall 18 and the post collar 14 on the other hand, to make possible a deflective movement between the post collar 14 and the base plate 16 inside the hollow space 17. After a defined limit value for the position of the post 12 and collar 14 relative to the base plate 16 is reached, after a relative movement (e.g., a predetermined relative movement) of the post 12, the collar 14 and the base plate 16 relative to one another, the post collar 14 comes in contact with the inner edge 29 of the upper collar 24 of the base plate 16, thereby creating a second direct contact between the post collar 14 and the base plate 16 as shown in FIGS. 5B and 5C. As a result of the first and second direct contact, a rigid whole is formed by the post 12, the collar 14, and the base plate 16 and this whole can only be moved further as a unit under the influence of a collision/impact.

Upon the application of an external force on the post 12, the post 12 and the reinforcing collar 14 are forced to move in an obliquely, downwardly directed sliding movement (direction E, see FIG. 5C) which forms a sharp angle A to the normal N of the bollard 10. The normal N is in a direction perpendicular to a plane representative of the ground plane GP (FIGS. 5B and 5C).

The direction of the damped, obliquely, downwardly directed sliding movement is preferably predetermined to be a sharp angle (a) to the normal (n) (the normal n being the direction perpendicular to the plane representative of the ground or support surface G plane). Preferably, the sharp angle A is within the range of 10° to 80°.

An energy-absorbing element 40 is provided in the hollow space 17 and is arranged in this hollow space so that, when assembled (See FIG. 5A) it presses the post collar 14 and base plate 16 always against one another in order to bring and maintain the bollard 10 in the normal position, i.e., the energy-absorbing element 40 has a resilience, the absorbed energy being released when the external forces F disappear.

The energy-absorbing element 40 is positioned between post collar 14 on the one hand and the ground or floor surface G to which the base plate 16 is secured on the other. Alternatively, the base plate 16 may be provided with a bottom plate 42 which seals the hollow space 17 in the base plate 16 at the bottom (See FIGS. 2 and 5A). It will be understood that this bottom plate 42 must be releaseably connected to the rest of the base plate 16 to enable the post 12 and post collar 14 to be inserted through the opening 26 when the bollard 10 is assembled.

The energy-absorbing element 40 may be assembled in different ways and may have different kinds of shapes. It is clear that many designs are possible where the damping and resilient properties of the energy-absorbing element 40 may be adapted as a function of the behaviour of the bollard to be achieved upon impact.

The operation of the bollard 10 according to the invention is simple and shall be described hereinafter. In FIG. 5A the bollard is in a mounted condition where it is left undisturbed. The main post 12 and post collar 14 stand vertically upright, wherein the resilience in the energy-absorbing element 40 on which the post collar 14 is supported ensures not only that this vertical position is maintained as long as no forces F (impact or wind load) are exerted on the bollard, but also that a first direct contact is established between the post collar 14 and the base plate 16. If an external force F is now exerted in a direction transverse the bollard (FIG. 5B), e.g., as a result of a collision by a vehicle or the like, the energy-absorbing element 40 will be compressed, absorbing impact energy during the collision because of the damping properties of the energy-absorbing element 40 (See FIG. 5B).

FIG. 5C illustrates in detail how the post 12, post collar 14 and the base plate 16 move relative to one another as a result of the compression and deformation of the energy-absorbing element 40. This relative movement between the post collar 14 and the base plate 16 is stopped once a defined limit value for the position of the post collar 14 relative to the base plate 16 is reached (FIG. 5C). At that moment the post collar 14 lies with its outside against the inner edge 29 of inner collar 24 of base plate 16, thereby creating a second direct contact between the post collar 14 and the base plate 16.

FIGS. 3 and 4 illustrate, respectively, top and bottom plan view of the present invention. As may be seen, the cylindrical embodiment of the invention has a concentric arrangement of the main post 12, the post collar 14, and the base plate 16.

Figure 6:
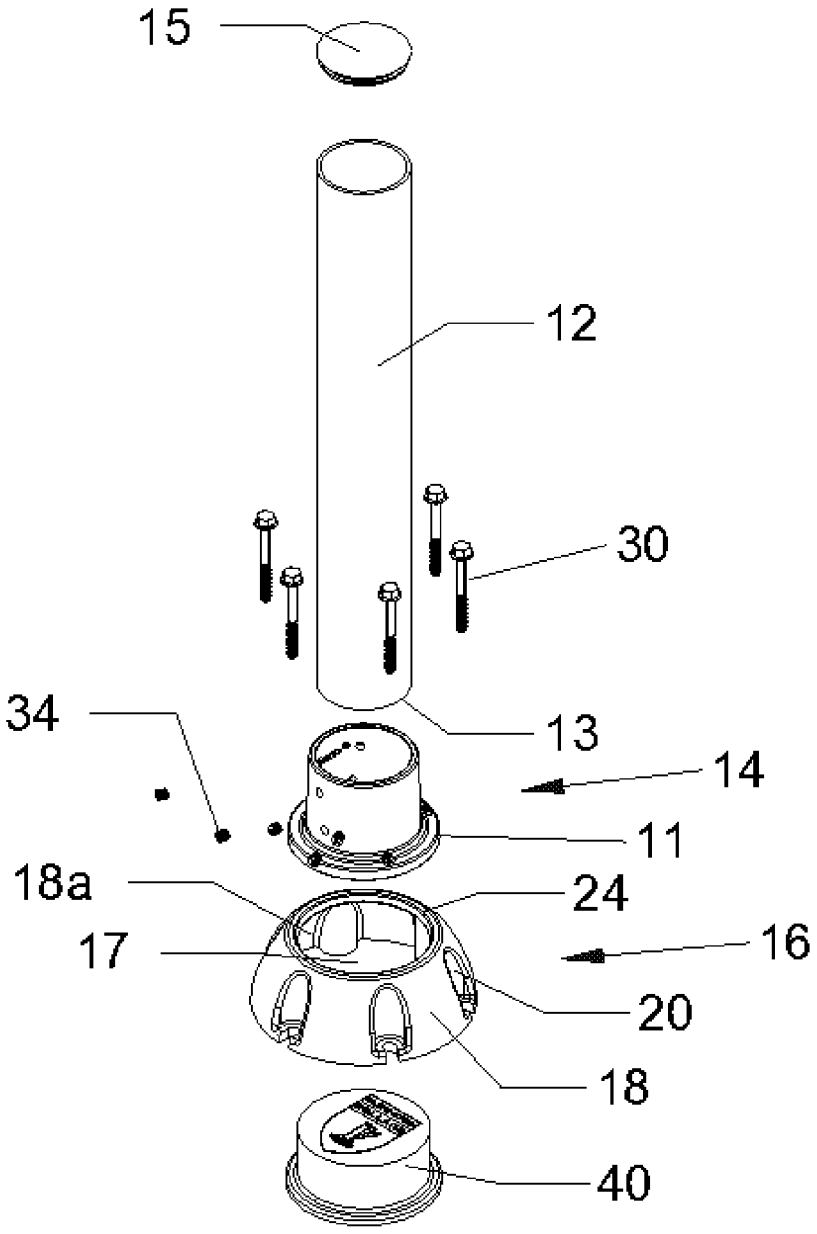
FIG. 6 illustrates an exploded perspective of the present invention.

FIG. 6 shows an exploded perspective of the present invention illustrating the arrangement of the various components in relation to one another.

Having now described the invention in conjunction with particularly illustrated embodiments thereof, variations and modifications may now naturally occur from time to time to those persons normally skilled in the art without departing from the essential scope or spirit of the invention, and accordingly it is intended to claim the same broadly as well as specifically as indicated by the appended claims.

The invention claimed is:

1. A bollard system comprising:

a post having upper and bottom portions;

a post collar member affixed to said bottom portion of said post, said post collar member having an inwardly extending flange portion and an outwardly extending flange portion, said post bottom portion engaging said inwardly extending flange portion of said post collar member;

a base plate having an arcuate outer wall and inwardly projecting mounting fastener notches around a bottom of said base plate; and an energy-absorbing element;

wherein said base plate is securable by mounting fasteners directly to an existing ground surface, to a foundation, to a support wall or to a supporting structure, said base plate having a hollow space formed by said post collar, an inner arcuate wall of said base plate, and said ground surface, foundation, support wall, or supporting structure, said mounting fasteners disposed in said inwardly projecting mounting fastener notches and extending through mounting holes in said bottom of said base plate, said arcuate outer wall extending from said bottom of said base plate to an upper collar and upper opening of said base plate;

said energy-absorbing element located within said hollow space and in a normal position said post, said post collar, and said base plate are in a first direct contact between said post collar and said base plate in a normal position said energy-absorbing element adapted to release energy absorbed during loading of said post by external forces when said external forces are removed; said energy-absorbing element further adapted to remain in direct contact with said post collar member and with said ground surface, said foundation, said support wall, or said supporting structure; and said post, said post collar member, said base plate and said energy-absorbing element are disposed relative to one another and adapted such that a first movement of said post relative to said base plate from said normal position of said bollard, said energy-absorbing element absorbs said first movement, and after a relative movement of said post and said base plate relative to one another, said post collar member contacts an inner edge of said upper collar of said base plate at said upper opening of said arcuate outer wall of said base plate defining a limit value of range for a position of said post relative to said base plate, a second direct contact is established between said post collar member and said base plate such that a further movement of said post relative to said base plate is no longer possible, a rigid whole formed of said post, said post collar, and said base plate;

said post and said base plate shaped and adapted such that, when said post is loaded above said base plate, an obliquely, downward directed sliding movement of said post and said post collar member relative to said base plate is obtained, and said sliding movement damped by said energy-absorbing element.

2. The bollard system of claim 1 wherein said obliquely, downwardly directed sliding movement forms a sharp angle to the normal of said bollard, said normal being a direction perpendicular to a plane representative of a ground plain.

3. The bollard system of claim 2 wherein said sharp angle is between 10° and 80°.

* * * * *